US007895781B2

(12) United States Patent
Gaetano

(10) Patent No.: US 7,895,781 B2
(45) Date of Patent: Mar. 1, 2011

(54) INDICIA DISPLAY DEVICE

(76) Inventor: John Gaetano, Redwood City, CA (US)

( * ) Notice: Subject to any disclaimer, the term of this patent is extended or adjusted under 35 U.S.C. 154(b) by 0 days.

(21) Appl. No.: 12/383,097

(22) Filed: Mar. 19, 2009

(65) Prior Publication Data

US 2010/0236115 A1 Sep. 23, 2010

(51) Int. Cl.
*G09F 7/00* (2006.01)

(52) U.S. Cl. ..... 40/488; 40/491

(58) Field of Classification Search ..... 40/488, 40/491

See application file for complete search history.

(56) References Cited

U.S. PATENT DOCUMENTS

| | | | |
|---|---|---|---|
| 1,573,344 | A | 2/1926 | Jordan |
| 2,117,187 | A | 5/1938 | MacLaren |
| 2,799,105 | A | 7/1957 | Titley |
| 2,833,066 | A | 5/1958 | Morrissey |
| 4,837,957 | A | 6/1989 | Egender |

*Primary Examiner*—Lesley Morris
*Assistant Examiner*—Shin Kim
(74) *Attorney, Agent, or Firm*—John C. McMahon

(57) ABSTRACT

A device having movable slats for visual display of a plurality of indicia, such as numbers, letters and/or symbols. The internal slat supporting structure is secured to prevent movement of portions thereof when struck or jostled. In some embodiments, the indicia are associated with the downs in a football game.

17 Claims, 6 Drawing Sheets

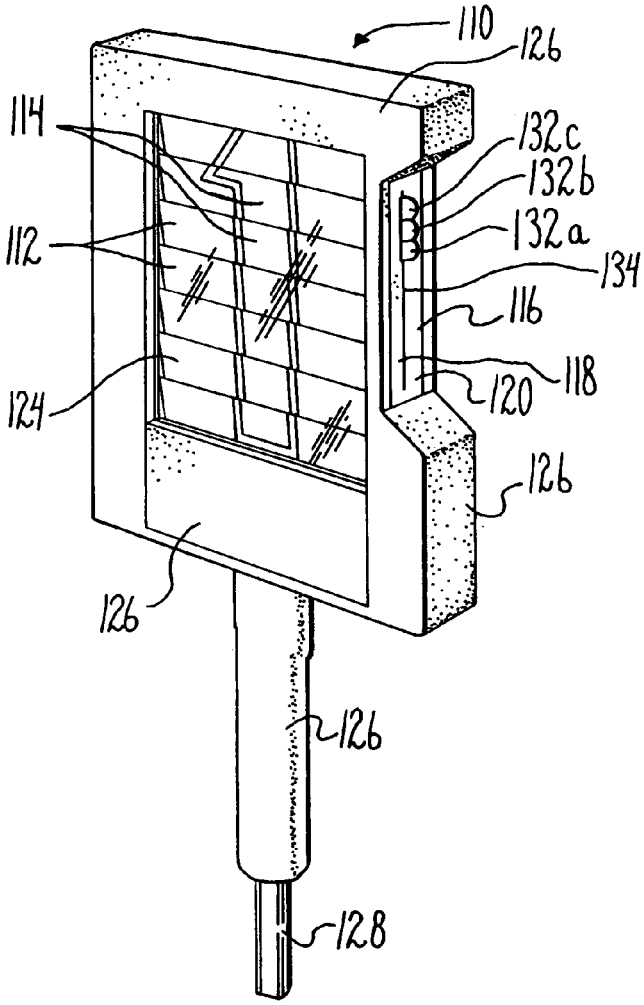
Fig. 1.
Fig. 3.
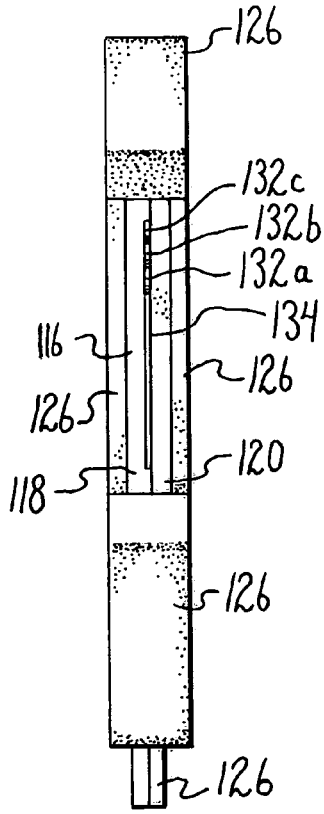

INDICIA DISPLAY DEVICE

BACKGROUND OF THE INVENTION

In many activities, such as, but not limited to sports, a plurality of events, such as balls, runs, downs, goals, and the like, occur. In general, these events are tracked, and indicia related to the events are displayed to participants and spectators. For example, in basketball, it is important to keep track of and display the number of fouls of each player. In baseball, it is important to keep track of and display the balls, strikes and outs as well as the runs of the game. In each of these sports, the indicia (e.g., numbers) are typically displayed on an electronic scoreboard that is visible to everyone, including spectators and participants.

Football presents a similar yet distinct problem. In football, an important event that must consistently be visible to players, officials, and spectators is what down it is. Although the current down is often kept on an electronic scoreboard, it is also necessary for the down to be maintained on the field along the sidelines at a location visible to the players and officials. Not only must the players and officials be able to quickly see what down it is by referring to the down marker on the field, in many situations, especially high school and junior football, the down marker on the field may be the only indicator of the downs for the spectator.

One type of numerical down marker that is used in football consists of a flip card device mounted on a stake. This flip card device normally has a set of four cards. Each card has a single number painted thereon (either 1, 2, 3 and 4), and the cards are joined together by two rings so that the cards can be flipped forward or backward to display the proper down. One of the problems with this type of down marker is that it is hazardous to the players in the game. The individual cards have sharp edges and are in no way provided with any protective padding. Since the down marker must be kept on the sidelines of the playing field at the line of scrimmage, a player will often run into, or be tackled into, the down marker. This can cause serious injuries to the players and to others in the immediate vicinity. An increasing number of players are injured in football, and any form of safety or protection to the player is desirous and needed for the game.

Another problem with the flip card device is that the rings on which the numbers are mounted are easily broken. When a ring breaks or when a number breaks off of the ring, the number becomes crooked and difficult for the players, officials and spectators to see. The flip card device is also bulky and slow to operate.

It is also possible to display numbers, such as prices in the retail situation or downs in the game of football, by means of an electronic number indicator. However, an electronic device to display numbers is often too expensive to be practical in many applications. The cost of continuously running an electric price board in a retail store would be prohibitive in most cases. In many sports, and especially in football, it is impractical to use an electronic number device as a sideline down marker, particularly in high school and junior league football. Providing an AC operated device would be impractical if not impossible, and it would also be costly and impractical to employ a battery operated device.

Other mechanical types of devices have been developed for the purpose of keeping track of downs. As noted above, the players sometimes run into the devices during the playing of games, oftentimes with substantial force. The prior art devices of this type have an internal structure that floats within an external frame and, because it is subject to significant forces when struck by one or more player, is often shook violently. Further, the prior art used a significant number of interior parts, especially sliding elements, so that the prior art was significantly subject to damage and failure.

SUMMARY OF THE INVENTION

In one embodiments, a system of movable slats configured and arranged for visual display of a plurality of numbers, wherein each of the numbers is associated with a down in a football game, is provided, wherein the system includes a housing having first and second sides, wherein the first and second sides each has a generally rigid frame and a transparent display window, wherein the first and second sides are configured to cooperatively provide an enclosed interior, and wherein the frame has at least three pivot pin receptacles, and further wherein the frame has a plurality of support leg receiving members; a non-movable support located in the enclosed interior and comprising a plurality of support legs configured and arranged for coupling with the support leg receiving members, wherein the non-movable support is mounted on the frame and substantially stabilized when the support legs are coupled with the support leg receiving members; a non-movable set of slats attached to the non-movable support and configured to cooperatively respectively display a number associated with a fourth down in a football game; three movable supports located in the enclosed interior, wherein each movable support is slidably attached to the non-movable support and configured and arranged to be moved between a first position and a second position; three movable sets of slats, wherein each set is attached to a movable support, wherein each set comprises a plurality of slats, configured to cooperatively display a number associated with a first down, a second down or third down in a football game, and wherein the number is selectively displayable through the transparent window when the associated movable support is in the first position and the number is not displayed when the movable support is in the second position; three arms, wherein each arm has an exterior portion and an interior portion, wherein the exterior portion of the arm is configured to extend out of the housing, such that the arm exterior portion is accessible to a user, wherein each arm interior portion includes a pivot pin configured to be received in and rotatably engaged by a pivot pin receptacle, and wherein the arm interior portion is movably coupled to a respective movable support, whereby movement of the arm exterior portion to a first position cooperatively moves the movable support to the first position, and movement of the arm exterior portion to a second position cooperatively moves the movable support to the second position, whereby the user is allowed to select to display any one of the four numbers associated with the downs of the football game.

In one aspect of the first embodiment, the device includes a friction ridge located between the arms and the frame. The friction ridge is configured and arranged to frictionally engage the arms, whereby the arms are stabilized in the first position, but moveable by application of force by the hand of a user on the respective exterior portion to the second position.

In a second aspect of the first embodiment, the movable and non-movables sets of slats are configured and arranged to display the numbers associated with the downs in opposing directions via the transparent windows.

In a second aspect, a numerical-display system for sequential display in opposed directions of a plurality of numbers associated with a plurality of downs in a football game, is provided, including first and second matable rectangular housing panels, wherein each housing panel has a rigid frame including two side portions, a top portion and a bottom portion, a transparent window, at least three pivot pin cups located in at least one side portion, and a plurality of leg locks located in the frame, wherein when mated the first and second matable rectangular housing panels cooperatively provide a housing interior and a housing exterior; an immobile slat support located within the housing interior and comprising a plurality of support legs configured and arranged to immovably engage the leg locks, whereby the immobile slat support is mounted on the frame and substantially immobilized within the housing interior; an immobile set of slats attached to the immobile slat support, and configured and arranged to cooperatively display a number associated with a fourth down in a game of football; three movable slat supports located within the housing interior and slidably attached to the immobile slat support, and configured and arranged to be sequentially and selectively moved between a first position and a second position, wherein each of the movable slat supports includes: a pair of vertical beams; a horizontal beam connecting the vertical beams; and a detent guide located in the horizontal beam; three sets of mobile slats, wherein each of the sets of mobile slats is attached to one of the three movable slat supports, wherein each of the sets of mobile slats is configured and arranged to cooperatively display a number associated with a first, second or third down in a football game when the movable support to which the set is attached is in the first position and to not display the number when the movable support is in the second position; at least three lever arms, wherein each of the at least three lever arms is associated with one of the movable slat supports, wherein each lever arm includes: a handle configured to protrude from the housing interior to the housing exterior, wherein the handle includes an up position and a down position; a central portion comprising a detent operably coupled with the detent guide, wherein the detent is configured for sliding rotational movement within the detent guide when the handle is moved between the up and down positions; and a linkage end comprising a pivot pin configured to pivotally couple with one of the at least three pivot cups, wherein movement of the handle between the up and down positions is associated with pivoting the associated pivot pin within a coupled pivot pin cup.

In one aspect of the second embodiment, the fourth down number is displayed when the three movable supports are in the second position.

In a second aspect of the second embodiment, each lever arm is configured and arranged for operation by a user, whereby each of the four numbers is sequentially selectable and displayable.

In a second aspect of the second embodiment, the movable slat supports are substantially supported within the enclosed portion of the housing by the immobile slat support.

In a third aspect, an indicia display device for sequential selection and display of a plurality of indicia associated with events in an activity is provided, the device including: a housing comprising an interior portion, an exterior portion, and a plurality of sockets; a stationary support comprising a plurality of legs configured and arranged to couple with the sockets, whereby the stationary support is substantially immobilized within the interior portion of the housing; a plurality of slidable supports slidably coupled with the stationary support, wherein each of the slidable supports is configured and arranged for display of an indication associated with an event in an activity, wherein each slidable support has a display position, for display of the indication associated therewith, and non-display position; and a plurality lever arms, wherein each of the lever arms is operatively coupled with one of the slidable supports, wherein the lever arms are configured and arranged for movement of the slidable supports between the display position and the non-display position.

In a first embodiment of the third aspect, an the stationary support is configured and arranged for display of an indication associated with an event in the activity.

In another embodiment, the indicia are displayed on opposing sides of the device.

In another embodiment, the slidable supports are configured for sequential selection and display of the indicia.

In another embodiment, the indicia are numbers.

In another embodiment, the numbers are the numbers 1 through 4.

In another embodiment, the indicia are letters.

In another embodiment a plurality of sets of slats with each slat associated with a different respective indicia are mounted on moveable supports that are slidably mounted on a non moveable support and the non moveable has a plurality of legs with each leg positionally secured in a receiver of a fixed and rigid exterior frame and furthermore, wherein lever arms for selectively positioning the sets are pivotally secured to the fixed frame on one end and pivotally joined to the moveable support to allow a user to position the sets to select a particular indicia.

Other objects and advantages of this invention will become apparent from the following description taken in conjunction with the accompanying drawings wherein are set forth, by way of illustration an example, certain embodiments of this invention.

BRIEF DESCRIPTION OF THE DRAWINGS

The drawings constitute a part of this specification and include exemplary embodiments of the present invention and illustrate various objects and features thereof.

FIG. 1 is a perspective view of an indicia display device in accordance with the invention.

FIG. 3 is a side elevational view of the indicia display device.

DETAILED DESCRIPTION OF THE ILLUSTRATED EMBODIMENT

Figure 4:
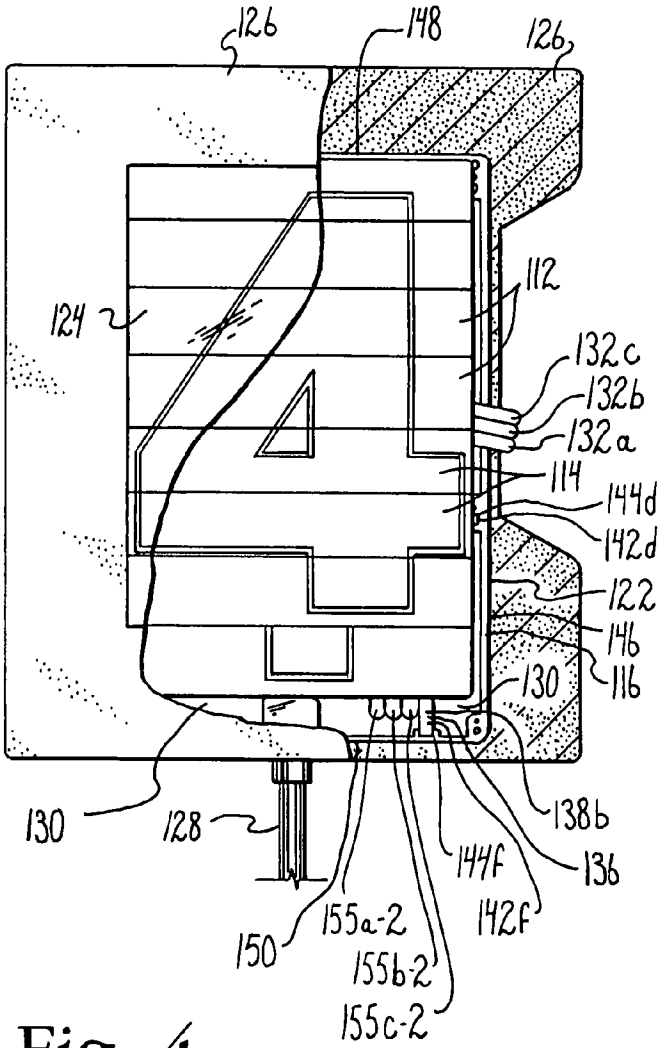
FIG. 4 is a front elevational view of the indicia display device with portions broken away to illustrate some internal parts, shown in a different configuration as compared to FIG. 2.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to FIG. 1, a device 110 for display (e.g., visual display) of indicia 114 is provided, wherein the indicia are displayed via a system of slats 112. In some embodiments, the indica are numbers (e.g., 1, 2, 3, . . . ), letters (e.g., A, B, C, . . . ) or other symbols (e.g., @, †, &, . . . ). In some embodiments, the indicia are associated with certain events of an activity, wherein the events are tracked, and the device is configured and arranged to display the indicia to event participants and/or spectators. In a further embodiment, the device is configured and arranged such that the indicia can be sequentially selected and displayed. In an exemplary embodiment, the device is a numerical-display system for sequential display in opposed directions of a plurality of numbers associated with a plurality of downs in a football game. In the latter embodiment, each of indicia (e.g., indications) is a number. For example, the numeral "1" is associated with a first down. The numeral "2" is associated with a second down. The numeral "3" is associated with a third down. The numeral "4" is associated with a fourth down.

Referring now to FIGS. 1-4, the device 110 includes a housing 116 that includes first and second sides (118 and 120, respectively), also referred to herein as side portions. The first and second sides 118 and 120 are mirror images of each other and each includes a generally rigid frame 122 and a transparent display window 124. The sides 118, 120 are formed of at least one impact-resistant plastic using manufacturing methods known in the art, such as but not limited to injection molding and machining. The first and second sides 118, 120 are preferably identical for ease of production and assembly. At least a portion of the window 124 is coated with an anti-glare (e.g., non-reflective) coating, such as to prevent glare caused by sunlight impinging upon the window, so that visibility of the indicia by a viewer is not hampered thereby.

The device 110 includes foam padding 126 attached to at least a portion of the frame 122 and optionally at least a portion of the window 124. In the illustrated embodiment that is shown in FIG. 1, the padding 126 is configured and arrange to cover substantially all of the exterior of the housing 116, except for the portion of the window(s) 124 through which the indicia 114 are displayed (e.g., viewable, viewed) to provide protection to players and other persons who may run into the device 110 during a game and also to insulate an interior of the device 110 from shock. In the illustrated embodiment, the padding 126 is configured and arranged to cover substantially less of the housing exterior. In some embodiments, the padding 126 is formed of impact-resistant foam or other protective material, such as is known in the art, so as to protect a person impacting (e.g., running into, crashing into) the device 110 from substantial injury. The device 110 is generally carried on a support 128, such as, but not limited to, a pole or stake, so as to lift the device to a convenient height (e.g., off of the ground) for viewing by activity participants and/or spectators during use. The padding 126 covers a portion of the support, such as but not limited to hardware used for connecting the device 110 to an upper end of the support 128.

The first and second sides 118, 120 are configured and arranged to cooperatively provide (e.g., via coupling or mating) an enclosed housing interior 130 that in this embodiment are secured together by bolts and nuts, not shown. It is foreseen that one skilled in the art understands that the sides can include a plurality of coupling members, for coupling the first and second sides together, and that a plurality of coupling methods, either alone or in combination, can be used to couple the sides together. Exemplary methods and/or devices include but are not limited to lugs or bosses with openings for nuts and bolts, or screws, pins, clamps, adhesives, and welding.

The plurality of indica 114 resides within the housing interior 130. A plurality of arms 132*a*, 132*b*, 132*c* (e.g., lever arms, handles) protrudes from the housing interior to the exterior through a slot 134 (e.g., opening) formed between spaced portions of the sides 118 and 120. The internal mechanism (e.g., for support and movement of the indicia 114) and the arms are described in greater detail below.

Figure 5:
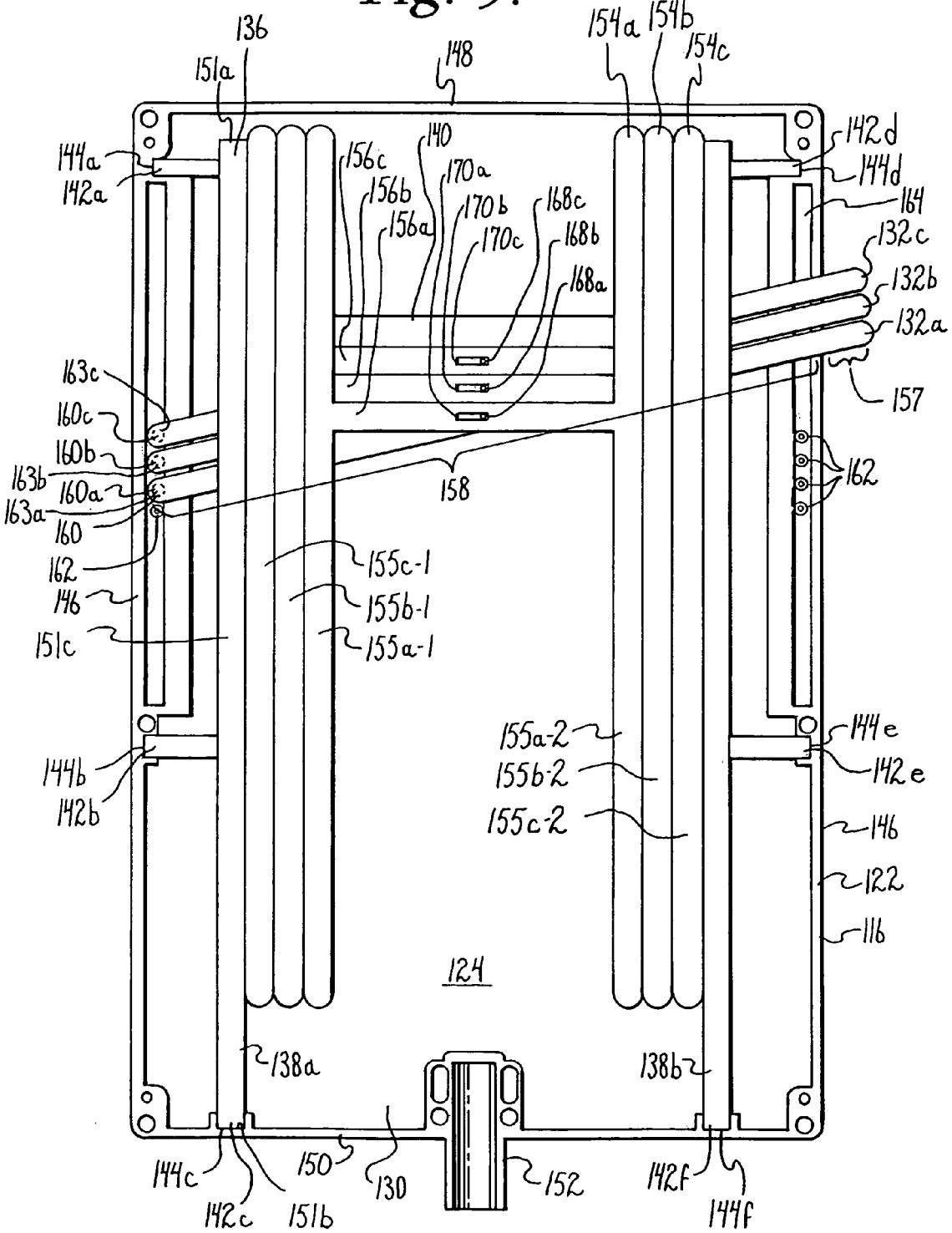
FIG. 5 is a view of the internal mechanism of an indicia display device within one side frame with the slats removed in a first configuration.

FIG. 5 is a schematic of the internal mechanism of the indicia display device (e.g., numerical-display device), with the slats 112 removed. The internal mechanism includes a plurality of supports, for the support and optional movement of the indicia. A non-movable support 136 is located in the enclosed interior 130 of the housing 116. The non-movable support 136 (e.g., an immobile slat support) that includes at least two vertical members 138*a*, 138*b* (e.g., vertical beams) and at least one horizontal member 140 (e.g., horizontal beam) securely and rigidly attached to, and thereby linking, the at least two vertical members. The non-movable support 136 includes a plurality of support legs 142*a*-142*f* (e.g., members, tabs) that are configured and arranged to couple with (e.g., mate with, be received by) a plurality of support leg receiving members 144*a*-144*f* (e.g., leg locks, sockets) located in the frame 122 of the housing 116, such that the non-movable support 136 is mounted on the frame 122 and substantially stabilized (e.g., stationary, immobilized) and rigidly held within and relative to the sides 118 and 120 and further with respect to the housing interior 130 when the support legs 142*a*-142*f* are coupled with the support leg receiving members 144*a*-144*f*. The legs 142*a*-142*f* of this embodiment are frictionally held in the receiving members 144*a*-144*f* and are also positioned therein and prevented from moving relative to the receivers 144*a*-144*f* by the geometry of the elements and an interference fit between the support legs 142*a*-142*f* and the sides 118 and 120.

As shown in FIG. 5, each of the first and second sides 118, 120 (e.g., matable rectangular housing panels) of the housing 116 includes two frame sides 146 (e.g., a side portion), a frame top 148 (e.g., top portion), a frame bottom 150 (e.g., bottom portion), and the transparent window 124. The sides 118 and 120 are generally rectangular, such as having a generally greater height than width. However, it is foreseen that the frame can be square, or its height can be smaller than its width.

Each of the first and second sides includes two support leg receiving members 144*a*-144*f* (e.g., leg locks) located on each of the two frame sides and on the frame bottom 150. Each of the vertical members 138*a*, 138*b* of the non-movable support 136 includes a plurality of support legs configured and arranged to couple with corresponding support leg receiving members on the frame. For example, vertical member 138*a* includes a top end 151*a*, a bottom end 151*b* and a middle portion 151*c*. A first leg 142*a*, which is located at (e.g., adjacent to, near) the top end 151*a* of the vertical member 138*a* extends laterally (e.g., horizontally) therefrom and engages support leg receiving member 142*a*. Alternatively, vertical member 138*a* can include a vertical support leg (e.g., leg 142*a*) that extends vertically to engage a support leg receiving member 144*a* located in the frame top 148. Another leg 142*b* extends laterally from the middle portion 151*c* of vertical member 138*a* and engages another support leg receiving member 144*b* located in the side portion 146 of the frame 122. A third leg 142*c* extends from the bottom end 151*b* of vertical member 138*a*, and is engaged by support leg receiving member 144*c*, which is located in the frame bottom 150. Alternatively, leg 142*c* can extend laterally from the bottom end 151*b* of vertical member 138*a*, similar to the manner of leg 142*a*. Vertical member 138*b* of the non-movable support includes a similar configuration of legs (142*d*, 142*e*, 142*f*) that are engaged by support leg receiving members (144*d*, 144*e*, and 144*f*, respectively) located on the frame 122.

It is foreseen that the vertical members can include 1, 2, 3, 4, or more support legs. The non-movable support 136 is substantially stabilized (e.g., immobilized) within the housing interior 130 and does not slide about therein because the support legs 142 (e.g., 142*a*-142*f*) are secured in the receiving members 144 (e.g., 144*a*-144*f*). The non-movable support 136 is sufficiently stabilized by the cooperative action of the coupled legs and receiving members 144 (e.g., 144*a*-144*f*) within the rigid frame 122 that the non-movable support 136 is not substantially moved or otherwise affected by one or more blows (e.g., impacts) to the device exterior, such as by a person running into or a ball hitting the device 110. The non-movable support 136 includes additional legs 142 (e.g., 142*a*-142*f*), each of which is configured and arranged to couple with an additional support leg receiving member 144 (e.g., 144*a*-144*f*) located in at least one of the two frame sides 146, a frame top 148, and a frame bottom 150.

The frame bottom 150 includes a neck portion 152 configured and arranged to cooperatively form a cylindrical housing neck when the first and second sides 118 and 120 are mated (e.g., coupled, attached together), whereby the housing can be attached to (e.g., mounted on) the support 128.

Referring again to FIG. 4, a non-movable (e.g., immobile) set of slats 112 (also referred to herein as a set of non-movable slats or immobile slats) is attached to the non-movable support 136. The slats 112 of the non-movable set are configured and arranged to cooperatively display an indication 114 (e.g., one of the indicia), such as a number, letter or symbol, as described elsewhere herein. In FIG. 4, the indication 114 is a number associated with a fourth down in a football game (e.g., the number "4"). Generally, the colors of the slats 112 and the indica 114 are selected to ensure visibility of the indicia by viewers at least 5, 10, 15, 20, 25, 30, 35, 40, 45, 50 or more yards away from the device. For example, it is foreseen that in some embodiments, the indicia are applied to (e.g., painted on, adhered to) white slats using fluorescent paint(s) known in the art. In another example, the indica include black or metallic borders configured to improve discernment of the indica by a viewer, such as a viewer located a distance (e.g., 5, 10, 15, 20, 25, 30, 35, 40, 45, 50 or more yards) from the device. In yet another example, the slat color (e.g., the background color) is clear, cream, beige, grey, yellow, blue, green, purple, black or metallic.

Figure 8:
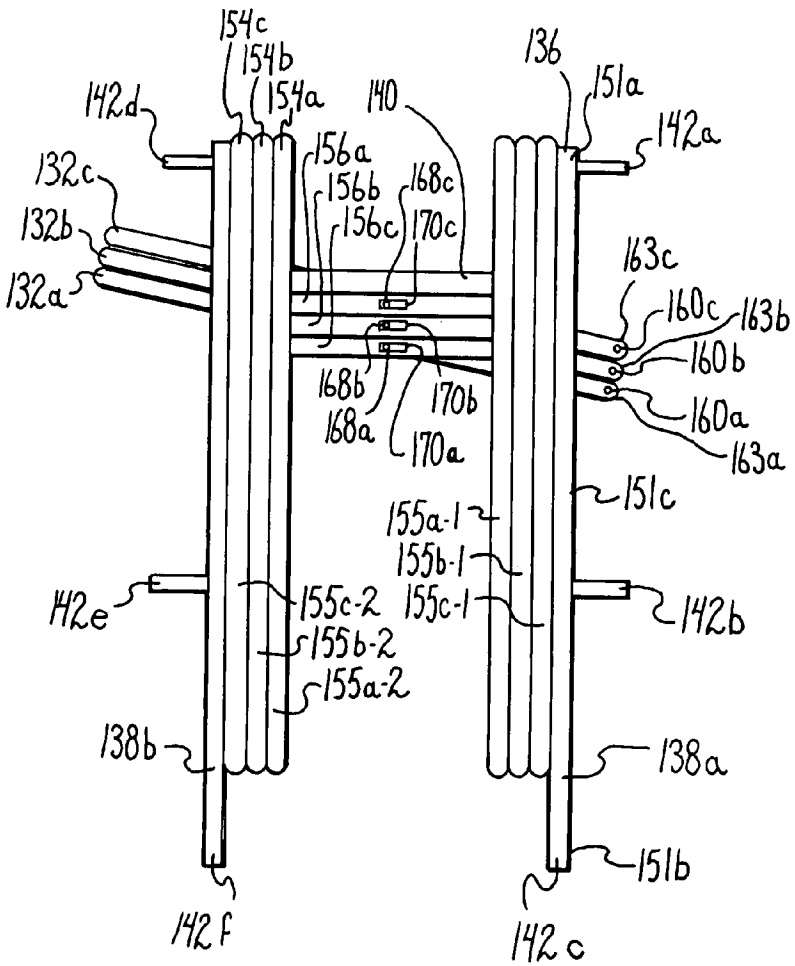
FIG. 8 is a rear elevational view of the internal mechanism of the indicia display device, of the device of in FIG. 6.
Figure 6:
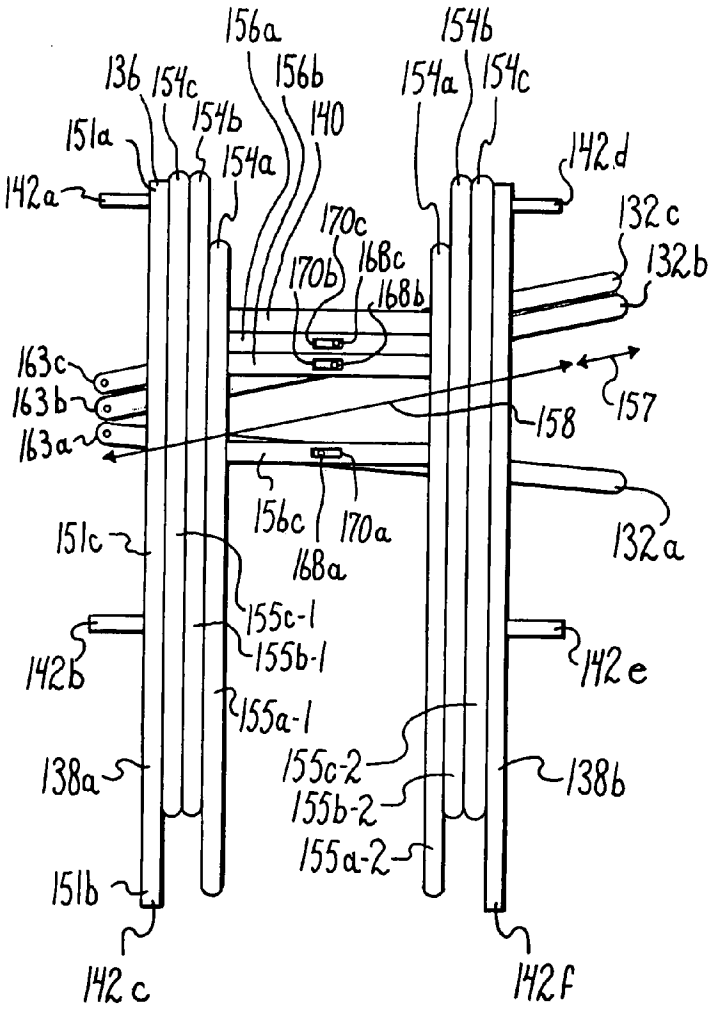
FIG. 6 is a view of the internal mechanism of an indicia display device, with the slats removed in a second configuration.
Figure 7:
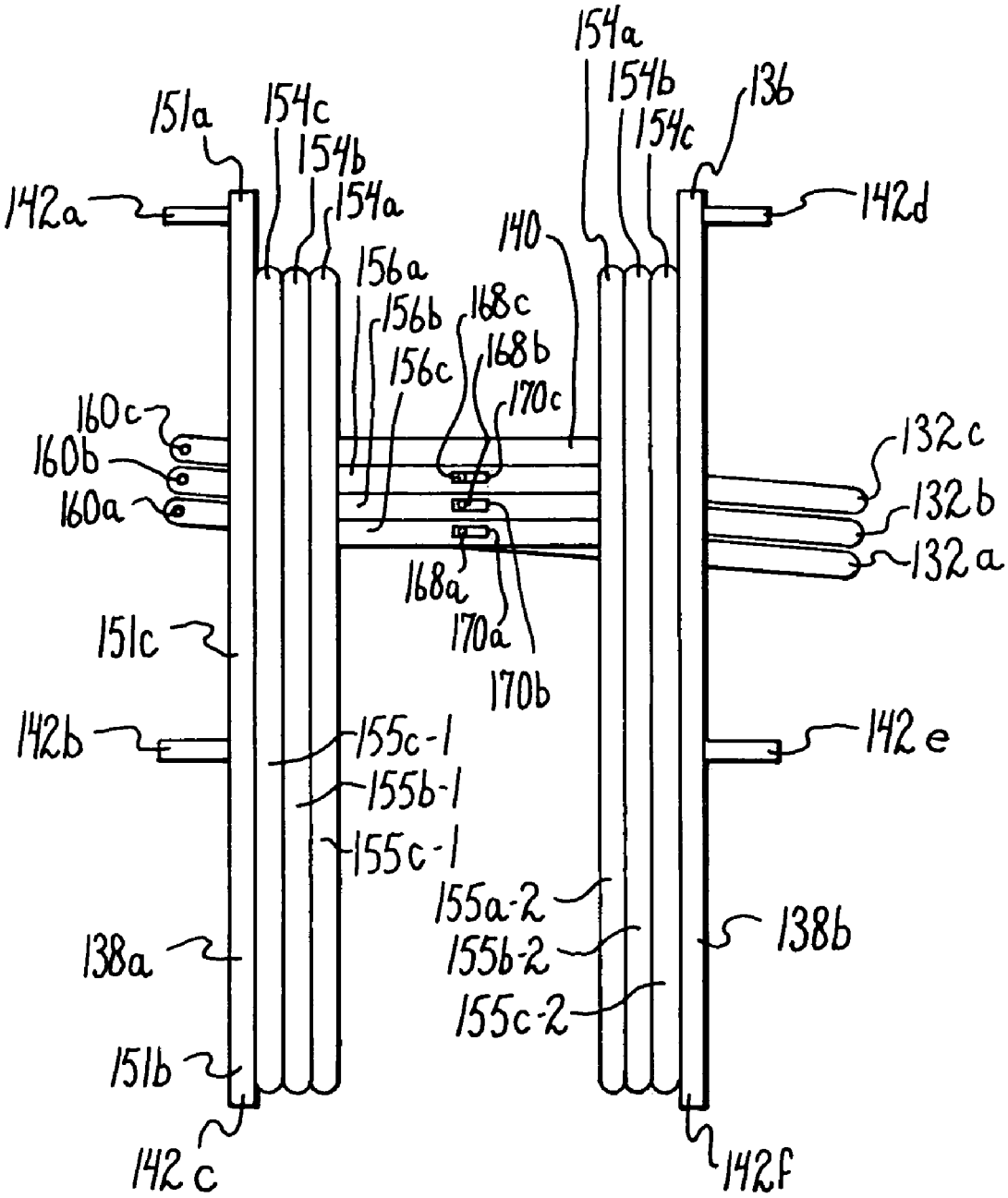
FIG. 7 is a view of the internal mechanism of the indicia display device of similar to FIG. 6, in a third configuration.

Referring again to FIGS. 5-8, a plurality of movable slat supports 154*a*, 154*b*, 154*c* (e.g., mobile slat supports) are located in the enclosed interior 130. Each movable support 154 includes at least two vertical members 155 (e.g., vertical beams) and at least one horizontal member 156 (e.g., horizontal beam). For example, movable support 154*a* includes two vertical members 155*a*-1, 155*a*-2 and one horizontal member 156*a*. Movable support 154*b* includes vertical members 155*b*-1 and 155*b*-2, and horizontal member 156*b*. Similarly, movable support 154*c* includes vertical members 155*c*-1 and 155*c*-2, and horizontal member 156*c*. The movable supports 154*a*-154*c* are slidably attached to the non-movable support 136 and configured and arranged to be moved between (e.g., placed in) a first position and a second position. For example, FIGS. 5 and 8 illustrate three movable supports 154*a*-154*c*, wherein all of the movable supports 154*a*, 154*b*, 154*c* are in the first position. In FIG. 6, a first movable support 154*a* is in the second position while the second and third movable supports 154*b*, 154*c* are in the first position. And, FIG. 7 shows all three of the movable supports 154*a*, 154*b*, 154*c* of this exemplary embodiment, in the second position. It is foreseen that in other embodiments, the device 110 includes 1, 2, 4, 5, 6, 7, 8, 19, 10 or more movable supports 154. Normally, the number of movable supports 154 is one fewer than the total number of indicia 114 that the device 110 is configured and arranged to display. The first position, also referred to herein as a display position, is generally upward with respect to the device 110, while the second position, also referred to herein as a non-display position, is generally downward with respect to the device 110.

Each of the movable supports 154*a*, 154*b*, 154*c* is configured and arranged to be supported by the non-movable support 138 and to be moved between a first (e.g., up, display) position and a second (e.g., down, non-display) position. The movable supports are configured and arranged to be moved sequentially from the first position to the second position (e.g., a first movable support 154*a*, then a second movable support 154*b*, and then a third movable support 154*c* is moved from the first position to the second position).

An arm 132 is associated with each of the movable supports 154. For example, in the embodiment shown in FIGS. 5-8, the device includes three arms 132*a*, 132*b*, 132*c*, each of which is associated with one of the three movable supports 154*a*, 154*b*, 154*c*, respectively. Each arm 132 has an exterior portion 157 (e.g., handle) and an interior portion 158 (e.g., see FIGS. 5-6). The exterior portion 157 of the arm is configured to extend out of the housing 116, such that the exterior portion 157 is accessible to a user. For example, a user can grasp and optionally manipulate the exterior portion 157. The interior portion 158 of each arm 132 includes a pivot pin 160. For example, in FIG. 8, arm 132*a* includes pivot pin 160*a*, arm 132*b* includes pivot pin 160*b*, and arm 132*c* includes pivot pin 160*c*. The pivot pins 160 are configured and arranged to be received in and rotatably engaged by a pivot pin receptacles 162 located on the frame 122 (e.g., the frame side 146, see FIG. 5). For example, in the embodiment shown in FIG. 5, at least three pivot pin receptacles 162 are located in each of the frame sides 146. It is foreseen that in other embodiments, the frame may include 4, 5, 6, 7 or more pivot pin receptacles 162 (e.g., located in a frame side 146). In some embodiments, the device includes more pivot pin receptacles 162 than pivot pins 160. The frame 122 includes at least one pivot pin receptacle 162 for each arm 132 (e.g., each pivot pin 160) of the device 110 such that each arm 132 is securely attached to but pivotally joined with the frame 122.

Figure 9:
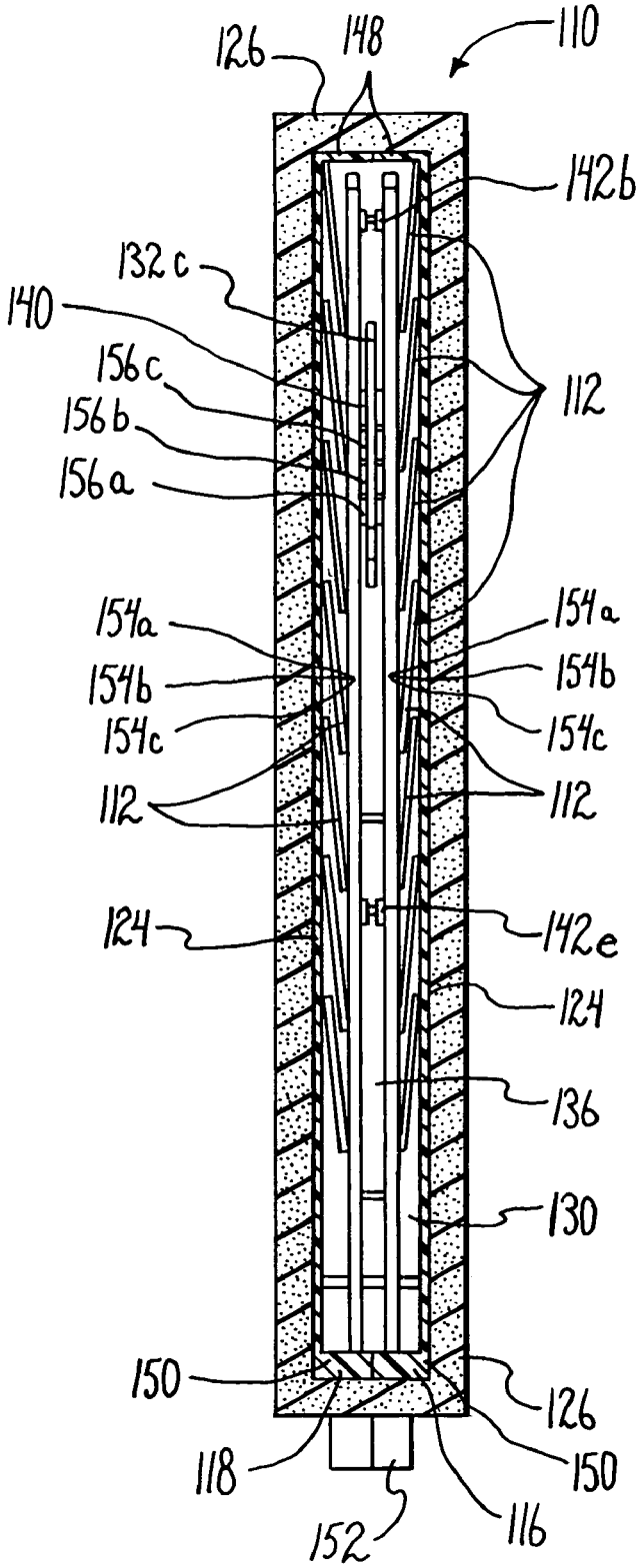
FIG. 9 is a cross sectional view of the indicia display device, taken along line 9-9 of FIG. 2.

Referring to FIG. 9, the device 110 includes pairs of movable slat supports 154 (e.g., a pair of movable slat supports 154*a*, a pair of movable slat supports 154*b*, and a pair of movable slat supports 154*c*), wherein each pair of movable slat supports 154 is attached to an associated with a particular indicia on a set of slats 112 configured and arranged for display of a respective indicia 114 (e.g., via attached sets of slats) in opposing directions (e.g., back-to-back), so as to show through both transparent windows 124 (e.g., simultaneously, at the same time). The pairs of movable slat supports 154 include a first position and a second position and are pivotally joined to a respective arm 132 at a location spaced from an associated pivot pin.

In particular, the pivot pin 160 of each arm 132 is located on the end (e.g., interior portion 158) of the arm that is farthest away from the exterior portion 157 (e.g., see FIG. 8). The arm interior portion 158 is thereby movably coupled to (e.g., engaged by) a respective pivot pin receptacle 162 (e.g., pivot pin cup), so as to be pivotally coupled to the frame 122 (e.g., a frame side 146). Thus, the pivot pin 160 rotates (e.g., pivots) within its associated (coupled, engaged) pivot pin receptacle 162 in response to movement (e.g., placement) of the arm exterior portion 157 associated with a user pushing upward or downward on a respective arm 132*a*, 132*b*, 132*c*, which simultaneously and cooperatively moves the associated movable support (e.g., 154*a*, 154*b*, 154*c*).

The interior portion of each arm (132*a*, 132*b*, 132*c*) includes a detent (e.g., finger, pin) 168*a*, 168*b*, 168*c* configured and arranged to engage a detent guide 170*a*, 170*b*, 170*c* located on the movable support 154*a*, 154*b*, 154*c* associated with that arm. The detents 168 and their associated detent guides 170 (e.g., detent 168*a* and detent guide 170*a*, detent 168*b* and detent guide 170*b*, detent 168*c* and detent guide 170*c*) are configured and arranged such that each detent 168 rotates and optionally slides within its associated detent guide 170 when the arm 132 is moved between the first and second positions. Simultaneously, movement of the detent 168 within the detent guide 170 causes the associated movable support 154 to be moved by the arm 132. For example, movement (e.g., placement) of the arm 132*a* exterior portion 157 to (e.g., in) a first position (e.g., by a user) cooperatively rotates (e.g., in a first direction, such as clock-wise) the arm's pivot pin 160*a* within its associated (e.g., coupled, mated) pivot pin receptacle 162*a*; the detent 168*a* slides within the detent guide 170*a*, and the movable support 154*a* is moved (e.g., placed) to (e.g., in) the first position. Similarly, movement (e.g., placement) of the arm 132*a* exterior portion 157 to (e.g., in) a second position cooperatively rotates (e.g., in a second direction, such as counter clock-wise) the arm's pivot pin 160*a* within its associated (e.g., coupled, mated) pivot pin receptacle 162*a*; the detent 168*a* moves in the opposite direction within the detent guide 170*a*, and the movable support 154*a* moves (e.g., places) to (e.g., in) the second position. Moveable supports 154 have vertical portions 155 that are spaced by connecting webs 156 (e.g., horizontal members, beams) to maintain a fixed spacing. The moveable slat supports 154 are spaced and positioned to abut against the vertical non-mobile support members 138 (e.g., legs) and/or adjacent moveable supports 154, so as to be held between the non-mobile support members 138 (e.g., legs) to prevent relative sideways or horizontal movements, but so as to show slidable vertical or up and down movement of the mobile supports 154 relative to the non-mobile supports legs 138.

Accordingly, the user can (e.g., is allowed to) select to display any one of the plurality of indicia which the device is configured and arranged to display. For example, a device configured and arranged for display of the numerals "1" through four "4", which are associated with the four downs of a football game, the user can move the exterior portions 157 of the arms 132*a*, 132*b*, 132*c* to select and display each of the four numbers, so as but not limited to, select and display the numbers, and further, so as but not limited to, select and display the numbers sequentially.

The arm 132*a*, 132*b*, 132*c* is a lever arm associated with a movable slat supports 154*a*, 154*b*, 154*c*, and including a handle 157, a central portion 158 and a linkage end 163*a*, 163*b*, 163*c*. The handle protrudes from the housing 116 interior to the housing exterior, and has an up position and a down position. The central portion 158 includes the detent 168*a*, 168*b*, 168*c* that is operably coupled with the detent guide 170*a*, 170*b*, 170*c* and configured for sliding rotational movement therein when the handle is moved between the up and down positions. The linkage end 163*a*, 163*b*, 163*c* includes the pivot pin 160*a*, 160*b*, 160*c* configured to pivotally couple with a responsive pivot cup 162 located in the frame 122 of the device housing 116, wherein movement of the handle between the up and down positions is associated with pivoting the associated pivot pin 160*a*, 160*b*, 160*c* within a coupled pivot pin cup 162. The illustrated device 110 includes at least three lever arms 132*a*, 132*b*, 132*c*, wherein each of the at least three lever arms 132*a*, 132*b*, 132*c* is associated with one of the movable slat supports 154*a*, 154*b*, 154*c*.

The device 110 further includes a friction ridge 164 (e.g., friction strip, stabilization strip) located between the arms 132*a*, 132*b*, 132*c* and the frame 122 (see FIG. 5). The friction ridge 164 is configured and arranged to interferingly or frictionally engage the arms 132*a*, 132*b*, 132*c*, whereby the arms 132*a*, 132*b*, 132*c* are stabilized in the first position, so as to require a user to physically touch a selected arm 132*a*, 132*b*, 132*c* and urge or bias the selected arm 132*a*, 132*b*, 132*c* to a new position. For example, the friction ridge 164 is located on the frame side 146 and adjacent to the slot 134 through which the exterior portions 156 of the arms 132*a*, 132*b*, 132*c* protrude. The arms 132*a*, 132*b*, 132*c* are bowed such that the portion of each arm that is in contact with the friction ridge firmly presses against the friction ridge 164. The device 110 includes a single friction ridge 164. The device 110 could include two friction ridges 164 (e.g., attached to each of the frame side of each of the first and second sides 118, 120 of the housing 116), such that at least a portion of each of the of the arms 132*a*, 132*b*, 132*c* is sandwiched between the two friction ridges 164 and the arms 132*a*, 132*b*, 132*c* are thereby stabilized when in the first position. Thus, when the arms 132*a*, 132*b*, 132*c* are in the first position (e.g., up) the friction between the friction ridge 164 and a selected arm 132*a*, 132*b*, or 132*c* counteracts the action of gravity upon the arm 132*a*, 132*b*, 132*c*, such that the arm 132*a*, 132*b*, 132*c* is substantially unlikely to inadvertently move to the second position (e.g., fall down) and cause the device 110 to inadvertently display a different indica 114 than was selected (e.g., by a user).

Referring to FIGS. 1, 2-4 and 9, the device 110 includes a plurality of movable sets of slats 112. The slats 112 of each set are configured and arranged to cooperatively display one of a plurality of indicia 114 (e.g., an indication) and are attached to one of the movable supports 154*a*, 154*b*, 154*c* (see FIG. 5). The movable sets of slats are configured and arranged such that each of the indicia 114 associated therewith is selectively displayable through the transparent window 124. For example, each of the movable sets of slats 112 can be moved between a first position (e.g., generally upward, display) and a second position (e.g., a generally downward, non-display) position by moving the connected movable frame 154*a*, 154*b*, 154*c* between the first and second positions. For example, each movable frame 154*a*, 154*b*, 154*c* can be moved between the first and second positions via an associated arm 132*a*, 132*b*, 132*c*, which, simultaneously moves the movable set of slats that are attached to the movable frame.

The movable sets of slats 112 are configured and arranged such that the each of indicia 114 are selectively displayable through the windows 124 of the first and second sides 118, 120 of the housing 116 simultaneously (e.g., on opposing sides of the device). The movable sets of slats 112 are configured and arranged such that the indicia 114 are selectively and sequentially displayable through the windows 124 of the first and second sides 118 and 120 of the housing 110 simultaneously.

Figure 2:
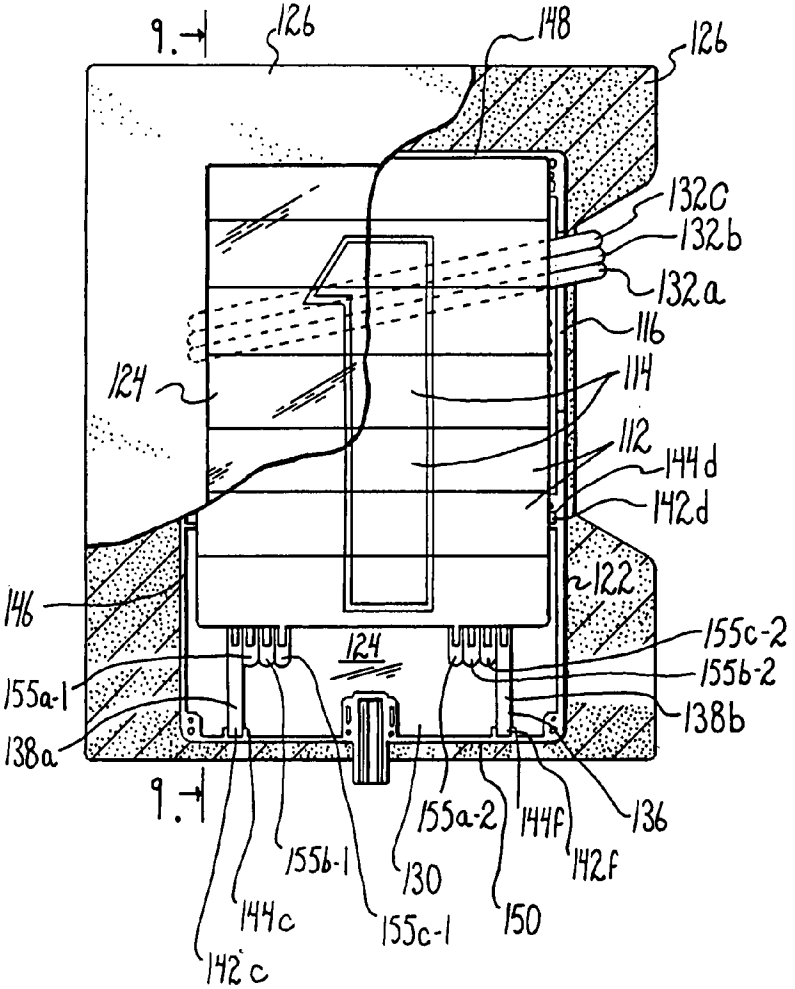
FIG. 2 is a front elevational view of the indicia display device with portions broken away to illustrate certain internal parts.

By way of example, the change in display of a first indica 114 to display of a second indica 114 can be discerned by the comparison of FIGS. 2 and 4. Both of these figures illustrate the front of the device 110, in one configuration, wherein the device 110 includes the non-movable support 136 and an attached set of non-movable slats 112 configured and arranged to display the numeral "4"; three movable supports 154*a*, 154*b*, 154*c*, wherein each movable support 154*a*, 154*b*, 154*c* has an attached movable set of slats 112 (e.g., each set configured and arranged for display of a different numeral, such as the numerals "1," "2," and "3"). In FIG. 2, all three of the arms 132*a*, 132*b*, 132*c*, and thus the corresponding attached movable supports 154*a*, 154*b*, 154*c*, are in the first position, and the numeral "1" is visible through the transparent window. Accordingly, all of the indicia 114 are in the first (e.g., up, display) position. In FIG. 4, all of the movable supports 154*a*, 154*b*, 154*c* are in the second (e.g., down, non-display) position, and the numeral "4" is displayed (e.g., visible) through the transparent window 124. In preferred embodiments, the device 110 is configured and arranged such that the indicia 114 are shown (e.g., displayed, visible) through the window 124 of each of the first and second sides 118, 120 of the housing 116 (e.g., displayed on opposing sides of the device 110).

As shown, the indicia 114 are numbers associated with the downs of a football game. For example, the first down is associated with the numeral "1." The second down is associated with the numeral "2." And so on. In this embodiment, each of the three movable sets of slats 112 is configured and arranged to cooperatively display a number associated with a first down, a second down or a third down, wherein each of the numbers is selectively displayable through the transparent window 124 when an associated movable support 154*a*, 154*b*, 154*c* is in the first position (e.g., up position, display position) and the number is not displayed when the movable support is in the second position (e.g., down position, non-display position). Further more, a number associated with a fourth down (e.g., the numeral "4") is displayed (e.g., via the non-movable slats 136) when the movable sets of slats (e.g., supports attached thereto) are in the second position. In a further configuration, the movable and non-movables sets of slats 112 are configured and arranged to display the numbers associated with the downs in opposing directions via the transparent windows 124.

It is to be understood that while certain forms of the present invention have been illustrated and described herein, it is not to be limited to the specific forms or arrangement of parts described and shown.

What is claimed and desired to be secured by Letters Patent is as follows:

1. A device having a system of movable slats configured and arranged for visual display of a plurality of numbers, wherein each of the numbers is associated with a down in a football game, the device comprising:

a housing having first and second sides, wherein the first and second sides each has a generally rigid frame and a transparent display window, wherein the first and second sides are configured to cooperatively provide an enclosed interior, and wherein the frame has at least three pivot pin receptacles fixedly secured thereto, and further wherein the frame has a plurality of support leg receiving members fixedly secured thereto;

a non-movable support located in the enclosed interior and comprising a plurality of support legs configured and arranged for coupling with the support leg receiving members, wherein the non-movable support is mounted on the frame and substantially stabilized against movement relative to the frame when the support legs are coupled with the support leg receiving members;

a non-movable set of slats attached to the non-movable support and configured to cooperatively display a number associated with a fourth down in a football game;

three movable supports located in the enclosed interior, wherein each movable support is slidably attached to the non-movable support and configured and arranged to be moved between a first position and a second position;

three movable sets of slats, wherein each set is attached to a respective movable support, wherein each set comprises a plurality of slats, configured to cooperatively display a number associated with a first down, a second down or third down in a football game, and wherein the number is selectively displayable through the transparent window when the associated movable support is in the first position and the number is not displayed when the movable support is in the second position;

three arms, wherein each arm has an exterior portion and an interior portion, wherein the arm exterior portion of the arm is configured to extend out of the housing, such that the arm exterior portion is accessible to a user, wherein each arm interior portion includes a pivot pin configured to be received in and rotatably engaged by a pivot pin receptacle so as to secure each arm to the frame but also so as to allow pivotal movement of each arm relative to the frame, and wherein the arm interior portion is movably coupled to a respective movable support, whereby movement of the arm exterior portion to a first position cooperatively moves the movable support to the first position, and movement of the arm exterior portion to a second position cooperatively moves the movable support to the second position, whereby the user is allowed to select to display any one of the four numbers associated with the downs of the football game and whereby both the arms and the non moveable support structure are secured to the frame to prevent substantial movement of the non moveable support structure relative to the frame even when the frame is jolted.

2. The device of claim 1, further comprising a friction ridge located between the arms and the frame, and configured and arranged to frictionally engage the arms, whereby the arms are stabilized in the first position.

3. The device of claim 1, wherein movable and non-movables sets of slats are configured and arranged to display the numbers associated with the downs in opposing directions via the transparent windows.

4. A numerical-display device for sequential display in opposed directions of a plurality of numbers associated with a plurality of downs in a football game, comprising:

first and second matable rectangular housing panels, wherein each housing panel comprises:

a rigid frame comprising two side portions, a top portion and a bottom portion, a transparent window, at least three pivot pin cups located in at least one side portion, and a plurality of leg locks located in and fixedly secured to the frame, wherein when mated the first and second matable rectangular housing panels cooperatively provide a housing interior and a housing exterior;

an immobile slat support located within the housing interior and comprising a plurality of support legs configured and arranged to engage the leg locks, whereby the immobile slat support is mounted on the frame and substantially immobilized within the housing interior relative to the frame;

an immobile set of slats attached to the immobile slat support, and configured and arranged to cooperatively display a number associated with a fourth down in a game of football;

three movable slat supports located within the housing interior and slidably attached to the immobile slat support, and configured and arranged to be sequentially and selectively moved between a first position and a second position, wherein each of the movable slat supports includes:

a pair of vertical beams;

a horizontal beam connecting the vertical beams; and a detent guide located in the horizontal beam;

three sets of mobile slats, wherein each of the sets of mobile slats is attached to a respective one of the three movable slat supports, wherein each of the sets of mobile slats is configured and arranged to cooperatively display a number associated with a first, second or third down in a football game when the movable support to which the set is attached is in the first position and to not display the number when the movable support is in the second position;

three lever arms, wherein each of the three lever arms is associated with one of the movable slat supports, wherein each lever arm includes:

a handle configured to protrude from the housing interior to the housing exterior, wherein the handle includes an up position and a down position;

a central portion comprising a detent operably coupled with the detent guide, wherein the detent is configured for sliding rotational movement within the detent guide when the handle is moved between the up and down positions; and a linkage end comprising a pivot pin configured to pivotally couple with a respective one of the three pivot cups, wherein movement of the handle between the up and down positions is associated with pivoting the associated pivot pin within a coupled pivot pin cup and the immobile slat support is secured to present relative movement between the immobile slat support and the frame during usage.

5. The system of claim 4, wherein the fourth down number is displayed when each of the three movable supports are in the second position thereof.

6. The system of claim 4, wherein each lever arm is configured and arranged for operation by a user, whereby each of the four numbers is sequentially selectable and displayable.

7. The system of claim 4, wherein the movable slat supports are substantially supported within the enclosed portion of the housing by the immobile slat support.

8. An indicia display device for sequential selection and display of a plurality of indicia associated with events in an activity, the device comprising:

a housing comprising an interior portion, an exterior portion, and a plurality of fixed sockets;

a stationary support comprising a plurality of legs configured and arranged to couple with the sockets, whereby the stationary support is substantially immobilized relative to the interior portion of the housing;

a plurality of slidable supports slidably coupled with the stationary support, wherein each of the slidable supports is configured and arranged for display of an indication associated with an event in an activity, wherein each slidable support has a display position, for display of the indication associated therewith, and non-display position; and a plurality lever arms, wherein each of the lever arms is operatively coupled with one of the slidable supports, wherein the lever arms are configured and arranged for movement of the slidable supports between the display position and the non-display position.

9. The device of claim 8, wherein the stationary support is configured and arranged for display of an indication associated with an event in the activity.

10. The device of claim 8 or 9, wherein the indicia are displayed on opposing sides of the device.

11. The device of claim 8, wherein the slidable supports are configured for sequential selection and display of the indicia.

12. The device of claim 11, wherein the indicia are numbers.

13. The device of claim 12, wherein the numbers are the numbers 1 through 4.

14. The device of claim 11, wherein the indicia are letters.

15. In a football down indicating device wherein a plurality of sets of slats within a rigid frame are selectively moveable from a non viewing position to a viewing position and wherein the sets of slats are mounted on moveable slat supports that are supported by non moveable slat support; the improvement comprising wherein the frame having a plurality of fixed receivers and the non moveable slat support having a pair of legs that are secured in the frame receiver to prevent relative movement between the non moveable support and the frame during usage.

16. The device according to claim 15 wherein the non moveable support legs include portions that extend both vertically and horizontally to opposite sides of the frame and are secured at the opposite sides and bottom by the receiver.

17. The device according to claim 15 wherein the device also includes activating arms that pre securely and pivotally joined at one end thereof to the frame and each arm is medially pivotally joined to a respective moveable slat support.

* * * * *